United States Patent [19]

Trasko

[11] Patent Number: 4,872,686

[45] Date of Patent: Oct. 10, 1989

[54] GOLF COURSE AND METHOD OF PLAYING A GOLF GAME

[76] Inventor: Theodore W. Trasko, 15370 Transit Ct., Unit 106, North Fort Myers, Fla. 33903

[21] Appl. No.: 102,783

[22] Filed: Sep. 23, 1987

Related U.S. Application Data

[63] Continuation of Ser. No. 742,092, Jun. 6, 1985, abandoned.

[51] Int. Cl.[4] ..... A63B 67/02

[52] U.S. Cl. ..... 273/176 AB

[58] Field of Search ..... 273/176 R, 176 A, 176 AA, 273/176 AB, 176 D

[56] References Cited

U.S. PATENT DOCUMENTS

| | | | |
|---|---|---|---|
| 3,083,021 | 3/1963 | Reilly | 273/176 |
| 3,156,470 | 11/1964 | Newkirk | 273/176 AB |
| 3,685,832 | 7/1972 | Johnson | 273/176 A |
| 3,695,619 | 10/1972 | Brobston | 273/176 A |
| 3,719,360 | 3/1973 | Purdy | 273/176 A |
| 3,892,413 | 7/1975 | Rotolo | 273/176 AB |
| 3,904,209 | 11/1975 | Thomas | 273/176 A |
| 4,145,053 | 3/1979 | Healey | 273/176 AB |
| 4,157,831 | 6/1979 | Renn | 273/176 AB |
| 4,189,152 | 2/1980 | Raber | 273/176 AB |
| 4,225,136 | 9/1980 | Beam | 273/176 AB |

OTHER PUBLICATIONS

"Golf World", Jul. 20, 1962, p. 15 relied on.

*Primary Examiner*—George J. Marlo
*Attorney, Agent, or Firm*—Jeffrey M. Morris

[57] ABSTRACT

A substantially rectangular golf course comprises a grouping of three relatively close holes spaced from a plurality of tee areas each for playing a respective hole. This arrangement can be combined in side by side or mutually opposed relation with one or more reptitions of the same arrangement. The course is played by teeing off for all three holes in a grouping before putting out on any hole in that grouping, and all holes are putted out before teeing off any further. All the holes in a grouping are played simultaneously as a group.

9 Claims, 16 Drawing Sheets

FIG. 2

LEGEND:

| HOLE | PAR | YARDS |
|---|---|---|
| 1 | 5 | 487 |
| 2 | 4 | 425 |
| 3 | 3 | 160 |
| TOTALS 3 | 1 1 1 | 1,072 |

20 ACRE - SIX HOLE GOLF COURSE

FIG. 4

LEGEND:

| HOLE | PAR | YARDS |
|---|---|---|
| 1 | 5 | 487 |
| 2 | 4 | 425 |
| 3 | 3 | 160 |
| 4 | 4 | 385 |
| 5 | 4 | 315 |
| 6 | 4 | 256 |
| TOTALS 6 | 1 4 1 | 2,028 |

FIG. 6

NINE HOLE LEGEND:

| HOLE | PAR | YARDS |
|---|---|---|
| 1 | 5 | 487 |
| 2 | 4 | 425 |
| 3 | 3 | 160 |
| 4 | 4 | 385 |
| 5 | 4 | 315 |
| 6 | 4 | 256 |
| 7 | 5 | 475 |
| 8 | 4 | 415 |
| 9 | 3 | 140 |
| TOTALS 9 | 52 | 3,058 |

FIG. 7

BACK NINE HOLE LEGEND:

| | HOLE | PAR | | | YARDS |
|---|---|---|---|---|---|
| | 10 | | | 5 | 475 |
| | 11 | | 4 | | 420 |
| | 12 | 3 | | | 160 |
| | 13 | | 4 | | 400 |
| | 14 | | 4 | | 360 |
| | 15 | | 4 | | 310 |
| | 16 | | | 5 | 475 |
| | 17 | | 4 | | 410 |
| | 18 | 3 | | | 170 |
| TOTALS | 9 | 2 | 5 | 2 | 3,180 |
| 18 HOLE GOLF COURSE TOTALS | 18 | 4 | 10 | 4 | 6,238 |

20 ACRE - 18 HOLE GOLF COURSE

FIG. 11

LEGEND:

| HOLE | PAR | | | YARDS |
|---|---|---|---|---|
| 1 | | | 5 | 485 |
| 2 | | 4 | | 410 |
| 3 | 3 | | | 200 |
| 4 | | 4 | | 390 |
| 5 | | 4 | | 360 |
| 6 | | 4 | | 380 |
| 7 | | | 5 | 485 |
| 8 | | 4 | | 395 |
| 9 | 3 | | | 120 |
| TOTALS 9 | 2 | 5 | 2 | 3,225 |

| HOLE | PAR | | | YARDS |
|---|---|---|---|---|
| 10 | | | 5 | 480 |
| 11 | | 4 | | 395 |
| 12 | 3 | | | 180 |
| 13 | | 4 | | 360 |
| 14 | | 4 | | 370 |
| 15 | | 4 | | 395 |
| 16 | | | 5 | 480 |
| 17 | | 4 | | 380 |
| 18 | 3 | | | 135 |
| TOTALS 9 | 2 | 5 | 2 | 3,175 |
| 18 HOLE TOTALS 18 | 4 | 10 | 4 | 6,400 |

FIG. 13

LEGEND:

| | HOLE | PAR | YARDS | | HOLE | PAR | YARDS |
|---|---|---|---|---|---|---|---|
| | 1 | 5 | 500 | | 10 | 5 | 480 |
| | 2 | 4 | 330 | | 11 | 4 | 280 |
| | 3 | 3 | 220 | | 12 | 3 | 160 |
| | 4 | 4 | 380 | | 13 | 4 | 350 |
| | 5 | 4 | 360 | | 14 | 4 | 350 |
| | 6 | 4 | 305 | | 15 | 4 | 280 |
| | 7 | 5 | 490 | | 16 | 5 | 480 |
| | 8 | 4 | 380 | | 17 | 4 | 350 |
| | 9 | 3 | 190 | | 18 | 3 | 130 |
| TOTALS | 9 | 252 | 3,155 | TOTALS | 9 | 252 | 2,860 |
| | | | 18 HOLE | TOTALS | 18 | 4 10 4 | 6,015 |

35± ACRES 18 HOLE GOLF COURSE

10 ACRE 6 HOLE GOLF COURSE

FIG. 15

LEGEND:

| HOLE | PAR | YARDS |
|---|---|---|
| 1 | 5 | 487 |
| 2 | 4 | 425 |
| 3 | 3 | 160 |
| 4 | 5 | 475 |
| 5 | 4 | 350 |
| 6 | 3 | 140 |
| TOTALS 6 | 22 | 2,037 |

10 ACRE 6 HOLE GOLF COURSE

GOLF COURSE AND METHOD OF PLAYING A GOLF GAME

This application is a continuation of application Ser. No. 742,092, filed June 6, 1985, now abandoned.

BACKGROUND OF THE INVENTION

A typical game of golf is played on a course of approximately 150 acres of land and takes approximately 4½ to 5½ hours to play 18 holes. In addition, a player typically walks or drives 4½ to 5 miles on an average 18 hole golf course.

Therefore, there is a need for a golf course and method of play which not only allows the player to play an 18 hole game in less time than it would normally take to play a typical 18 hole course, but which also maintains the regulation yardage of play in a smaller area of land than typically required.

DESCRIPTION OF THE PRIOR ART

Several U.S. patents disclose golf course designs on which a so-called "game" of golf can be played. Most of these courses are contained on a smaller area of land than a typical regulation golf course, but a regulation game cannot be played on them. Examples of these are: Reilly, U.S. Pat. No. 3,083,021; Johnson, U.S. Pat. No. 3,685,832; Purdy, U.S. Pat. No. 3,719,360; Healey, U.S. Pat. No. 4,145,053; and Renn, U.S. Pat. No. 4,157,831. For example, Johnson and Reilly disclose course layouts where the players shoot their balls in one direction for their wood shots and then shoot another ball in another direction for their iron shots. In Healey, each "hole" is played, respectively, and with woods and long irons; middle irons; and short irons and putting. Renn and Purdy disclose regulation size courses which are laid out in a compact area, but these courses have many disadvantages.

In Renn, while the area of the course layout is less than a conventional golf course area, the amount of time played and distance traveled is not substantially less than a conventional course. Indeed, the time it would take to play a round of golf on the course disclosed in Renn, may be longer than a conventional course, because the fairways of many holes intersect which would cause the players to wait until players on intersecting holes have finished shooting, or risk injury from balls being shot across their fairway. Likewise, the area of the course disclosed in Purdy is less than a conventional golf course area, but there is no substantial savings in time played and distance traveled.

SUMMARY OF THE INVENTION

A golf course design comprising a plurality of elongated cores disposed in an adjacent side by side lengthwise relation. Each of the cores has a pair of opposite ends. A plurality of greens are on each core, each green comprising at least one hole. A plurality of tee areas are on the golf course, each tee area being either on the same core as the hole which is played from that tee area or on an adjacent core. At least one hole on each core is located relatively close to one opposite end of each core and all holes on each core are located relatively remote from the other opposite end of each core. At least one of the tee areas on each core is located relatively close to the other opposite end of each core and all tee areas on each core are located relatively remote from the one opposite end of each core.

The golf course comprises an average of three holes per core, there being a tee area for each hole. The holes are arranged in groups of three relatively close holes and the greens for at least two holes in each group of three lie on the same core. At least two holes in each group of three are located relatively close to one opposite end of each core and all three holes are in a group of three are located relatively remote from the other opposite end of each core. The tee areas are arranged in groups of three, each tee area in a group corresponding to one of the holes in the group of three holes. At least two tee areas in each group of three are located relatively close to the other opposite core end of each core, and all three tee areas in the group of three are located relatively remote from the one opposite end of each core. The first tee area is situated to play one of the holes in the first group of three holes in par 5, a second tee area in the first group of tee areas is situated to play one of the holes in the first group of holes in par 4, and a third tee area in the first group of tee areas is situated to play one of the holes in the first group in par 3.

The method of playing a golf course comprising the steps of providing each of the plurality of players, playing together in a unit with golf balls visually distinguishable from the golf balls of every other player in that unit. Said unit playing the first group of three holes by teeing off from at least one tee area for all three holes in a group of three before initiating a shot to the green of any one hole. Said unit putting out on all of said first group of holes before teeing off on any further holes. Said unit playing a second group of three holes after putting out on all of said first group holes by teeing off from at least one tee area before initiating a shot to the green of any one hole in said second group of holes and then putting out on all of said second group of holes. A second group of players, playing together in a second unit different from the first recited unit with golf balls visually distinguishable from the golf balls of every other player in that second unit. Said second unit initially plays the first three group of holes after the first unit initiates a shot to the green for all three holes, by teeing off from at least one tee area before initiating a shot to the green of any one hole. The second begins to putt out on the first group of three holes after the first unit putts out on at least one of the three holes in the first group of holes.

A third group of players, playing together in a third unit, initially plays the first group of three holes after the second unit initiates a shot to the green for all three holes, by teeing off from at least one tee area before initiating a shot to the green of any one hole. A typical "core" is approximately ten acres and is preferably in the shape of a rectangle. The rectangle is approximately 1400 feet long and is approximately 330 feet wide. The holes are located on two basic type of putting greens; one type of green comprises one hole and the other type of green comprises two holes. Thus, with three groups of four players playing one 10 acre core, 12 golfers can play 18 holes of golf in approximately 2.5 hours. The 10 acre three hole course can be played six times for 18 holes of golf. The 20 acre course, having two, 3 hole cores, can be played three times for 18 holes of golf. The 30 acre course, having three, 3 hole cores, can be played twice for 18 holes of golf or once for 9 holes. The 60 acre course, having six, 3 hole cores, can be played once for 18 holes of golf.

These and other objects of the invention will become more apparent to those of ordinary skill in the art from the following detailed description of the preferred embodiment of the invention, considered and interpreted in view of the accompanying drawing.

DESCRIPTION OF THE DRAWING

FIG. 2 is a legend of a golf course disclosed in FIG. 1.

FIG. 4 is a legend of the golf course disclosed in FIG. 3.

FIG. 6 is a legend of the golf course disclosed in FIG. 5.

FIG. 7 is a legend of the back nine holes of the golf course disclosed in FIG. 5.

FIG. 10 is a plan view of the same golf course disclosed in

FIG. 9 showing holes 10 through 18 being played.

FIG. 11 is a legend of the golf course disclosed in FIG. 9 and FIG. 10.

FIG. 13 is a legend of the golf course disclosed in FIG. 12.

FIG. 15 is a legend of the golf course disclosed in FIG. 14.

DESCRIPTION OF THE PREFERRED EMBODIMENT

A. The golf course layout

Figure 1:
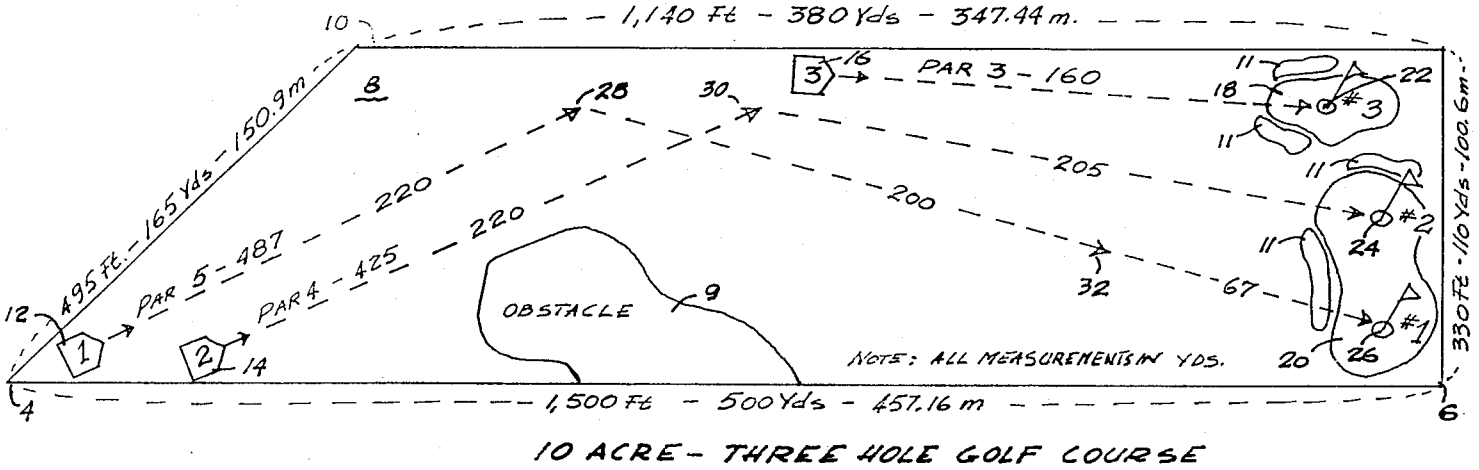
FIG. 1 is a plan view of a 10 acre, three hole golf course.

Referring to FIG. 1 there is disclosed golf course 10 comprising an elongated core 8 having a pair of opposite ends 4 and 6. A plurality of putting greens 18 and 20 are located on core 8. Each green comprises at least one hole. Putting green 18 comprises hole 22 and putting green 20 comprises holes 24 and 26. A plurality of tee areas 12, 14 and 16 are also located on core 8. Holes 22, 24 and 26 are arranged relatively close to one another so that the longest distance between adjacent holes (22 and 24 or 24 and 26) is relatively small compared to the shortest distance between any of the three holes and its corresponding tee area, in FIG. 1 this being the distance between hole 22 and tee area 16. In the preferred embodiment of the invention at least one hole is located relatively close to end 6 and all of the holes are located relatively remote from the other opposite end 4. All of the tee areas, 12, 14 and 16 and all of the holes 22, 24 and 26 are located on core 8.

There are an average of three holes to be played per core and there is a tee area for each corresponding hole. At least two holes in each group of three are located relatively close to end 6 and all three holes in a group are located relatively remote from end 4. The tee areas are arranged in groups of three, each tee area corresponding to one of the holes of the group of three holes. At least two areas 12 and 14 are located relatively close to end 4. All three tee areas are located relatively remote from end 6. At least one tee area 16 is located relatively remote from end 6. Tee area 16 (hole No. 3) is situated to play hole 22 in par 3. Tee area 14 (hole No. 2) is situated to play hole 24 in par 4, and tee area 12 (hole No. 1) is situated to play hole 26 in par 5.

As shown in FIG. 1, each green in the plurality of greens 18, 20 is outside the area between any other green in that plurality of greens and any of the tee areas in the plurality of tee areas 12, 14, 16. In addition, all of the tee areas between opposite core ends 4 and 6 (i.e. tee areas 12, 14 and 16 in FIG. 1) are outside of the area between any two greens in the plurality of greens 18, 20.

Hole No. 1 is a typical 5 par, 487 yard hole. The ball is ideally shot 220 yards to point 28 on the fairway. The second shot for hole No. 1 is a 200 yard shot to point 32 on the fairway. The third shot for hole No. 1 is a 67 yard shot to green 20. The fourth and fifth shots for hole No. 1 are putting shots to cup 26. Hole No. 2 is a typical par 4, 425 yard hole. The first shot is ideally a 220 yard shot to point 30 on the fairway. The second shot is a 205 yard shot to green 20, and the third and fourth shots are putting shots to cup 24. The third hole is a par 3, 160 yard hole. The first shot is approximately 160 yards to green 18. The second and third shots are putting shots to cup 22.

Golf course 10 is only approximately 10 acres in area having a substantially rectangular shape. It is approximately 1500 feet/500 yards long and 330 feet/110 yards wide. An obstacle 9 such as a small lake or trees may be placed on the course. Also, sand traps 11 may be placed adjacent to green areas.

Figure 3:
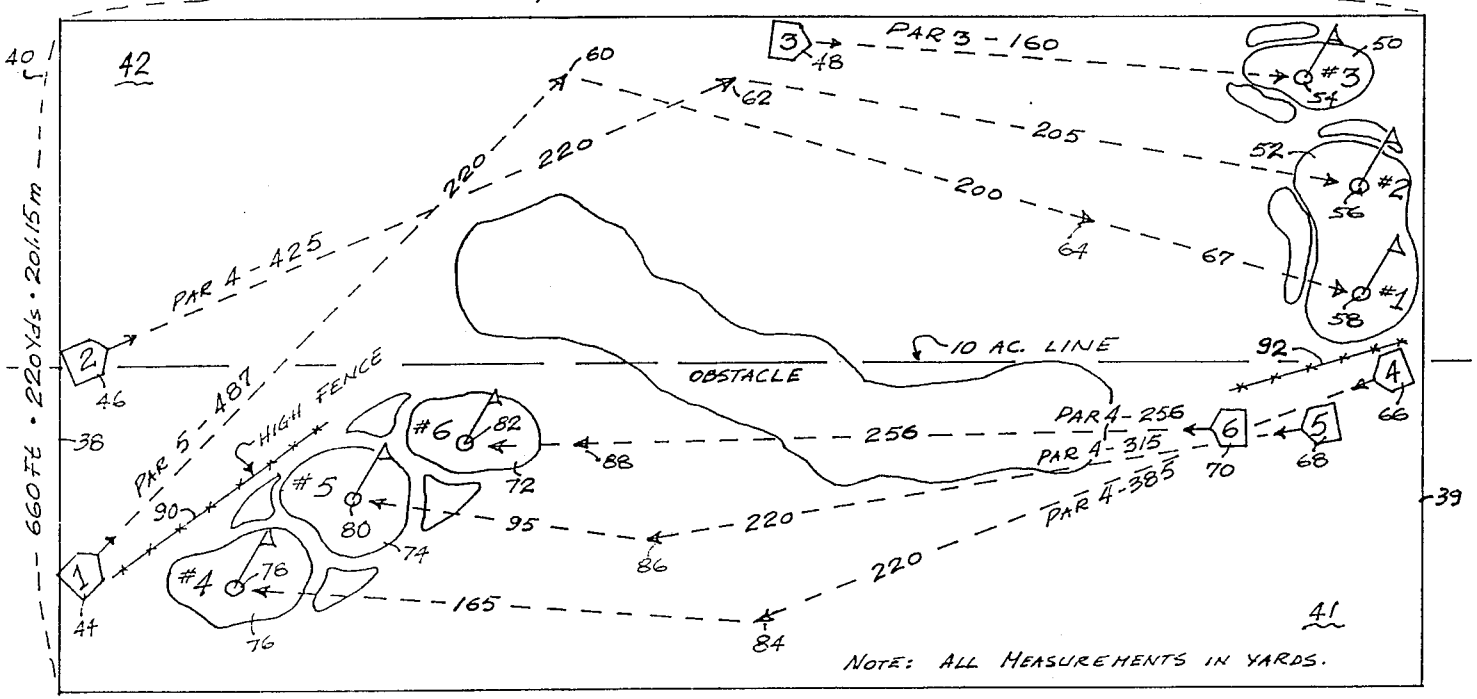
FIG. 3 is a plan view of a 20 acre, six hole golf course.

Referring to FIG. 3, there is disclosed a golf course 40 which comprises a plurality of elongated cores 41 and 42 disposed in an adjacent, side-by-side, lengthwise relation. Each of the cores, 41 and 42 have a pair of opposite ends 38 and 39. A plurality of greens 50, 52, 72, 74 and 76 are on cores 42 and 41. Each green comprises at least one hole and a plurality of tee areas 44, 46, 48, 66, 68 and 70 located on cores 41 and 42. Tee area 44 representing hole No. 1 is located on core 41 and tee areas 46 and 48, representing hole Nos. 2 and 3 respectively, are substantially located on core 42. Tee areas 66, 68 and 70, representing hole Nos. 4, 5 and 6, respectively, are substantially located on core 41 and green areas 72, 74 and 76 are located on core 41. Each tee area is either on the same core as the hole from which it is played or is on an adjacent core. Holes 54, 56 and 58 are located relatively close to end 39 and holes 78, 80 and 82 are located relatively close to end 38. These same holes are located relatively remote from the other opposite end of each respective core. Tee areas 44 and 46 are located relatively close to end 38 and tee areas 66, 68 and 70 are located relatively close to end 39.

There are an average three holes per core and there is one tee are for each hole. The holes are arranged in groups of three relatively close holes and the greens for at least two holes in each group of three lay on the same core. The definition of "relatively close" as applied to the group of three holes 22, 24, 26 in FIG. 1 is equally applicable to the groups of relatively close holes in the other Figs., including FIG. 3. At least two holes in each group of three are located relatively close to one opposite end of each core and all three holes in a group are located relatively remote from the other opposite end of each core. The tee areas are arranged in groups of three, each tee area in a group corresponding to one of the holes in a group of three holes. At least two tee areas in each group of three are located relatively close to the other opposite end of each core. All three tee areas in each group are located relatively remote from one opposite end of each core. The first tee area 44 (hole No. 1) is situated to play cup 58 in a first group of three holes, in par 5. A second tee area 46 (hole No. 2) is situated to play cup 56 in the first group of holes in par 4 and a third tee area 48 (hole No. 3) is situated to play cup 54 in par 3. The second group of three tee areas on core 41 has a fourth tee area 66 (hole No. 4) situated to play cup 78 in par 4. A fifth area 68 (hole No. 5) is situated to play cup 80 in par 4 and a sixth tee area 70 (hole No. 6) is situated to play cup 82 in par 4.

The location of each green in a plurality of greens, relative to the other greens in that plurality and to the corresponding tee areas for that plurality, and the location of the tee areas relative to the greens, as described in connection with the greens and tee areas in FIG. 1, are equally applicable to corresponding greens and tee areas in the other Figs., including FIG. 3.

FIG. 3 hole Nos. 1, 2 and 3 have approximately the same yardage as hole Nos. 1, 2 and 3 shown in the golf course of FIG. 1. Hole 4 is a par 4, 385 yard hole with the first shot ideally being a 220 yard shot to point 84 on the fairway. The second shot for hole 4 is a 165 yard shot to the green 76 and the third and fourth shots are putting shots to cup 78. Hole 5 is a par 4, 315 yard hole wherein the first shot is ideally a 220 yard shot to point 86 along the fairway. The second shot is a 95 yard shot to green 74. Hole 6 is a par 4, 256 yard hole wherein the first shot is ideally 200 yard shot to point 88 along the fairway. The second shot is to green 72, and the third and fourth shots are putting shots to cup 82. The golf course disclosed in FIG. 3 is rectangular in shape and comprises two-ten acre cores for a total of 20 acres. The course is approximately 1320 feet/440 yards long by 660 feet/220 yards wide.

FIG. 2 discloses a legend for the golf course disclosed in FIG. 1 which lists the total core yardage of 1,072 yards of play for 3 holes comprising a one par 3 hole, one par 4 hole and one par 5 hole. FIG. 4 discloses a legend for the golf course disclosed in FIG. 3 which lists a total of six holes having a total yardage of 2,028 yards of play. There is one par 3 hole, four par 4 holes and one par 5 hole.

Figure 5:
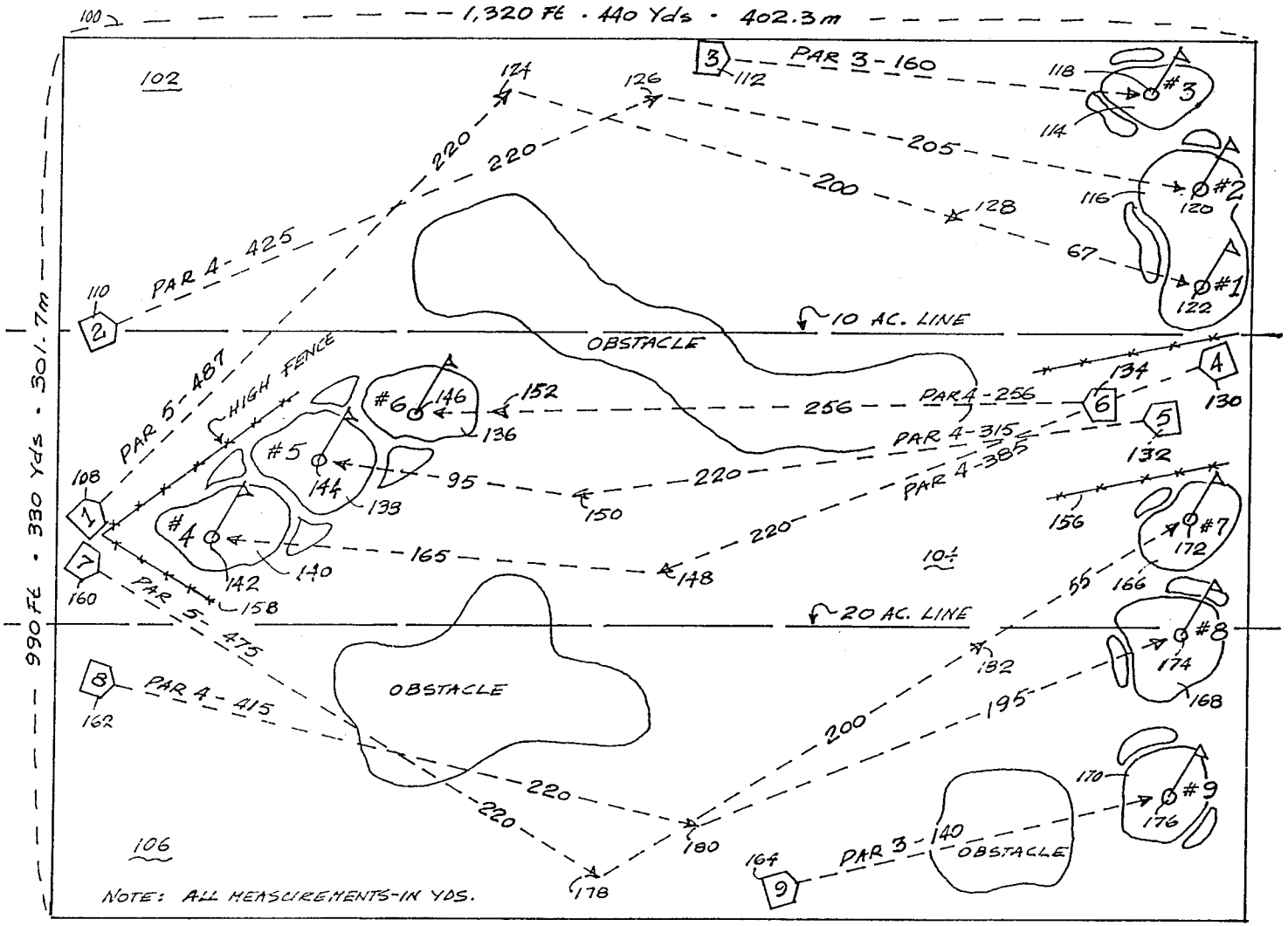
FIG. 5 is a plan view of a 30 acre, nine hole golf course.

FIG. 5 discloses a golf course comprising three-10 acre cores. Course 100 comprising cores 102, 104 and 106. This golf course is approximately 30 acres in size and cores 102 and 104 are substantially identical to the golf course disclosed in FIG. 3. New core 106 comprises a a third group of 3 tee areas, 160, 162 and 164 representing holes 7, 8 and 9. Tee area 160 does not necessarily have to be located on core 106. Tee area 160 is situated to play hole 7 in par 5. Tee area 162 is situated to play hole 8 par 4 and tee area 164 is situated to play hole 9 in par 3. Hole 7 is a par 5, 475 yard hole where the first shot is ideally a 220 yard shot to point 178 along the fairway. The second shot is a 200 yard shot to point 182 on the fairway and the third shot is a 55 yard shot to green 166. The fourth and fifth shots are putting shots to cup 172. Hole 8 is a par 4, 415 yard hole wherein the first shot is ideally a 220 yard shot to point 180 on the fairway. The second shot is a 195 yard shot to green 168 and the third and fourth shots are putting shots to cup 174. Hole 9 is a par 3, 140 yard shot to green 170 and the second and third shots are putting shots to cup 176.

FIG. 6 discloses a legend for the golf course disclosed in FIG. 5. FIG. 6 lists 9 holes for a total of 3,058 yards of play. There are two par 3 holes, five par 4 holes, and two par 5 holes. The golf course disclosed in FIG. 5 is approximately 1,320 feet/440 yards long and 990 feet/330 yards wide.

Figure 8A:
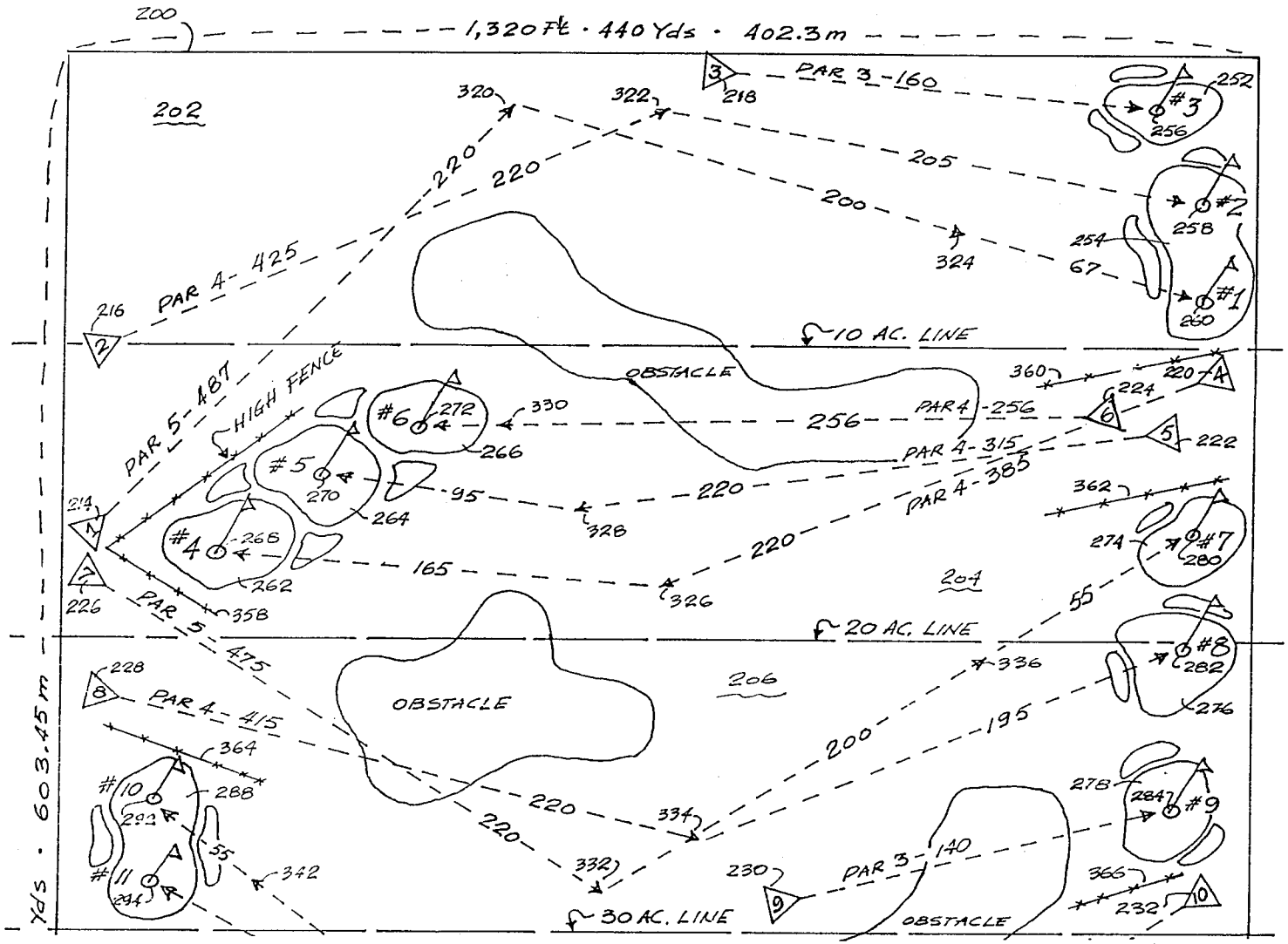
FIG. 8 is a plan view of a 60 acre, eighteen hole golf course.
Figure 8B:
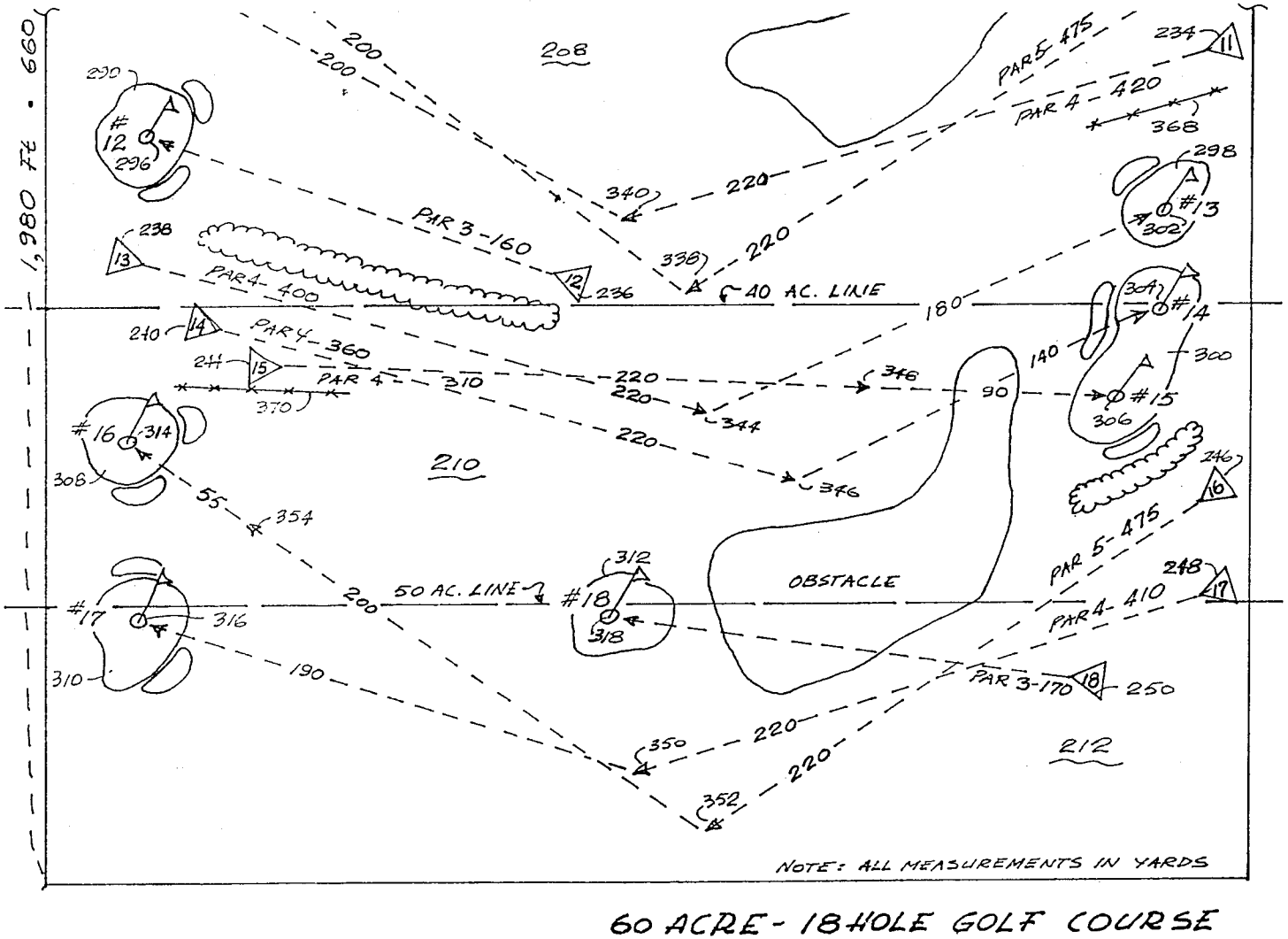

FIG. 8 discloses a 60 acre 6 core golf course 200 comprising 10 acre cores 202, 204, 206, 208, 210 and 212. Cores 202, 204 and 206 are substantially identical to the cores disclosed in the golf course shown in FIG. 5. An additional 9 holes are added to complete the 18 hole golf course. Fourth core 208 comprises a fourth group of tee areas 232, 234 and 236 and at least one tee area is located relatively close to one opposite end of core 208. At least one tee area is located on core 208. Tee area 232 is situated to play hole 10 in par 5, and tee area 234 is situated to play hole 11 in par 4. Tee area 236 is situated to play hole 12 in par 3. The fifth core 210, comprises a fifth group of tee areas 238, 240 and 244 having at least one tee area located relatively close to the other opposite end of core 210. At least one tee area of a fifth group of three tee areas is located on fifth core 210. Tee area 238 is situated to play hole 13, in par 4, a tee area 240 is situated to play hole 14 in par 4, and tee area 244 is situated to play hole 15 in par 4. A six core, 212 has a sixth group of tee areas 246, 248 and 250 with at least one tee area located relatively close to one opposite end of core 250. At least one tee area of the sixth group of three tee areas is located on core 212. Tee area 246 is situated to play hole 16 in par 5, tee area 248 is situated to play hole 17 in par 4 and tee area 250 is situated to play hole 18 in par 3.

Hole 10 is a par 5, 475 yard hole wherein the first shot is ideally a 220 yard shot to point 338 on the fairway of core 208. The second shot for hole 10 is a 200 yard shot to point 342 and the third shot is a 55 yard shot to green 288. The fourth and fifth shots are putting shots to cup 292. The eleventh hole is a par 4, 420 yard hold wherein the first shot is a 220 yard shot to point 340 on the fairway of core 208. The second shot is a 200 yard shot to green 288 and the third and fourth shots are putting shots to cup 294. Hole 12 is a par 3, 160 yard hole wherein the first shot is 160 yards to green 290 and the second and third shots are putting shots to cup 296. Hole 13 is a par 4, 400 yard hole with the first shot is a 220 yard shot to point 344 located on the fairway of core 210. The second shot is a 180 yard shot to green 298 and the third and fourth shots are putting shots to cup 302. Hole 14 is a par 4, 360 yard hole wherein the first shot is a 220 yard shot to point 346 on the fairway of core 210 and the second shot is a 140 yard shot to green 300. The third and fourth shots are putting shots to cup 304. Hole 15 is a par 4, 310 yard hole wherein the first shot is a 220 yard shot to point 348 along the fairway of core 210 and the second shot is a 90 yard hot to green 200. The third and fourth shots are putting shots to cup 306. Hole 16 is a par 5, 475 yard hole wherein the first shot is a 220 yard shot to point 352 along the fairway of core 212. The second shot is a 200 yard shot to point 354 along the fairway of core 210 and the third shot is a 55 yard shot to green 308. The fourth and fifth shots are putting shots to cup 314. Hole 17 is a par 4, 410 yard hold wherein the first shot is a 220 yard shot to point 350 along the fairway of the core 212. The second shot is a 190 yard shot to green 310 and the third and fourth shots are putting shots to cup 316. Hole 18 is a par 3, 170 yard hole wherein the first shot is 170 yards to green 312. The second and third shots are putting shots to cup 318.

Figure 9:
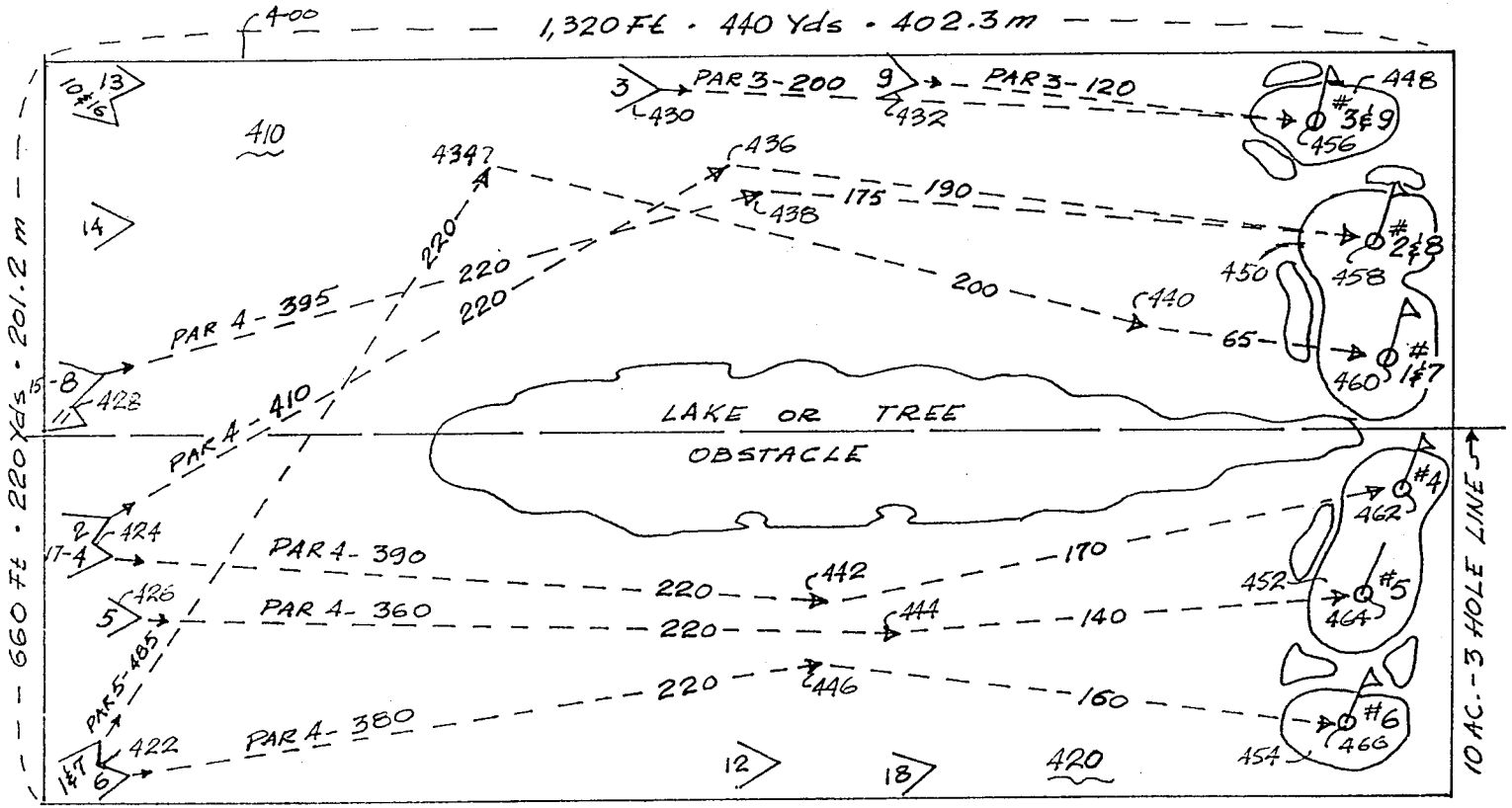
FIG. 9 is a plan view of a 20 acre, eighteen hole golf course showing holes 1 through 9 being played.
Figure 10:
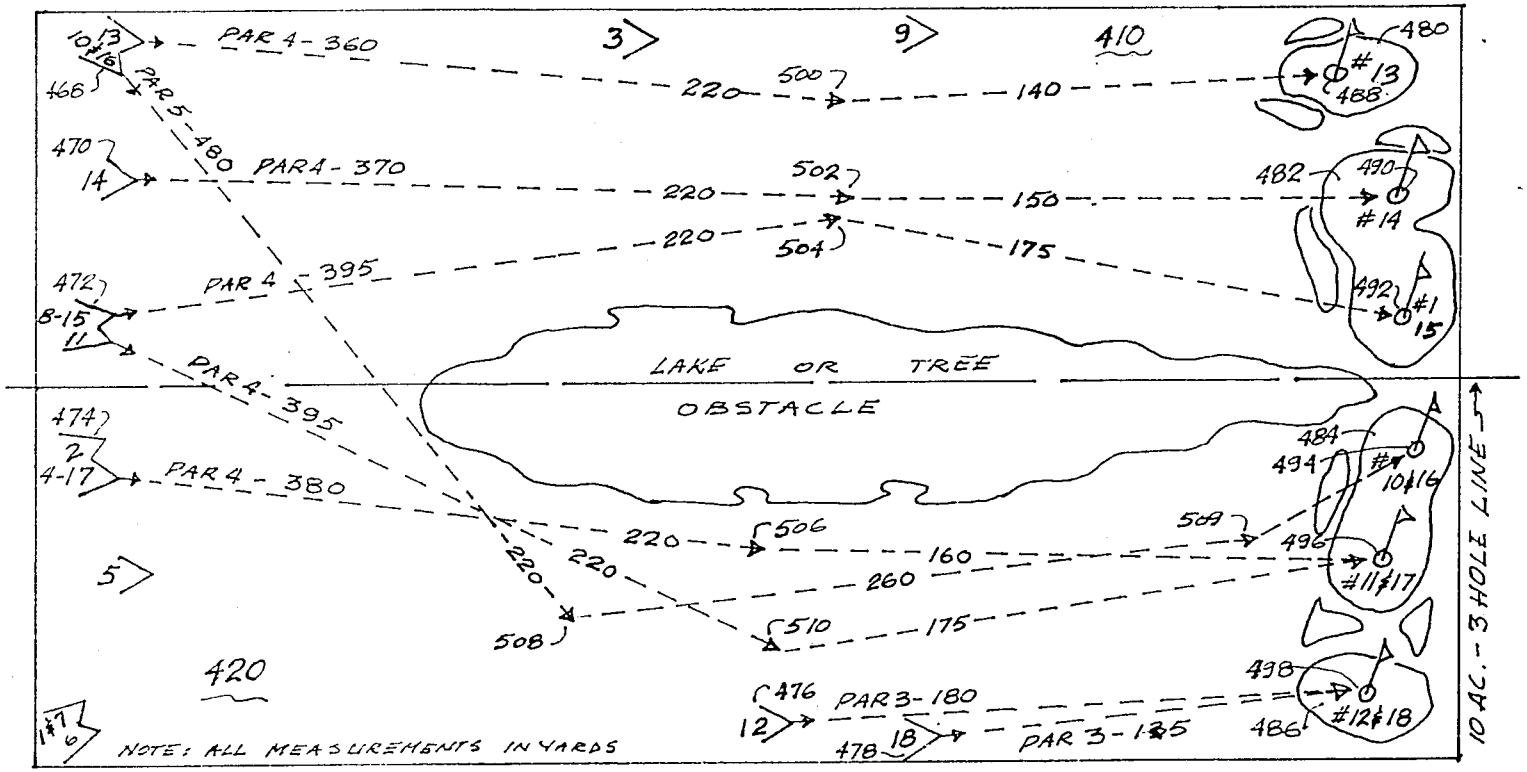

FIG. 9 and FIG. 10 disclose golf course 400. This golf course comprises two-10 acre cores 410 and 420. The primary difference between the golf course disclosed in FIGS. 9 and 10 with the courses disclosed in the preceding Figures is that the holes on both cores are located relatively remote from the same end and all the tee areas on both cores are located relatively remote from the same end and opposite that end from which the holes are remotely located. FIG. 9 shows, in dotted lines, the shots for playing the "front" nine holes of play on golf course 400. Holes 1, 7 and 6 share the same tee area 422. Hole 1 is par 5, 485 yard hole wherein the first shot is a 220 yard shot to point 434 on the fairway of core 410. The second shot is a 200 yard shot to point 440 and third third shot is a 65 yard shot to green 450. The fourth and fifth shots are putting shots to cup 460 on green 450. Hole 2 is located on the same tee area 424 with holes 4 and 17. Hole 2 is a par 4, 410 yard hole wherein the first shot is a 220 yard shot to point 436 along the fairway of core 410. The second shot is a 190 yard shot to green 450 and the third and fourth shots are putting shots to cup 458. Hole 3 is located on teeing area 430 and that hole is a par 3, 200 yard hole. The first shot is a 200 yard shot to green 448 and the second and third shots are putting shots to cup 456. Hole 4 is located on tee area 424 and is a par 4, 390 yard hole. The first shot is a 220 yard shot to point 442 along the fairway of core 420, and the second shot is a 170 yard shot to green 452. The third and fourth shots are putting shots to hole 462. Hole 5 is located on tee area 426 and that hole is a par 4, 360 yard hole wherein the first shot is a 220 yard shot to point 444 along the fairway of core 420. The second shot is a 140 shot to green 452 and the third and fourth shots are putting shots to cup 464. Hole 6 is located on tee area 422 on core 420. That hole is a par 4, 380 yard hole wherein the first shot is a 220 yard shot to point 446 along the fairway of core 420. The second shot is a 160 yard shot to green 454, and the third and fourth shots are putting shots to cup 466. Hole 7 is identical to hole 1 as can be seen in of FIG. 9. Hole 8 is a par 4, 395 yard hole from tee area 428. The first shot is a 220 yard shot to point 438 along the fairway of core 410 and the second shot is a 175 yard shot to green 450. The third and fourth shots are putting shots to cup 458. Hole 9 is a par 3, 120 yard hole from tee area 432. The first shot is a 120 yard shot to green 448 and the second and third shots are putting shots to cup 456.

FIG. 10 discloses, in dotted lines, the shots for playing the "back" 9 holes of play for the golf course disclosed in FIG. 9. Hole 10 is a par 5, 480 yard play from tee area 468 to green 484. The first shot is 220 yards to point 508 on the fairway on core 420. The second shot is 200 yards to point 509, and the third shot is 60 yards to green 484. The last two shots are putting shots to cup 494. Hole 11 is a par 4, 395 yard shot from tee area 472 to green 484. The first shot is 220 yards to point 510 on the fairway on core 420. The second shot is 175 yards to green 484. The last two shots are putting shots to cup 496. Hole 12 is a par 3, 135 yard shot from the area 476 to green 486. The first shot is 135 yards to the green, and the last two shots are putting shots to cup 498. Hole 13 is a par 4, 360 yard hole located on tee area 468. The first shot is a 220 yard shot to point 500 along the fairway of core 410. The second shot is a 140 yard shot to green 480, and the third and fourth yard shots are putting shots to cup 488. Hole 14 at tee area 470 is a par 4, 370 yard hole wherein the first shot is a 220 yard shot point 502 on the fairway of core 410. The second shot is a 150 yard shot to green 482, and the third and fourth shots are putting shots to cup 490. Hole 15 is a par 4, 395 yard hole from tee area 472. The first shot is a 220 yard to point 504 along the fairway of core 410, and the second shot is a 175 yard shot to green 482. The third and fourth shots are putting shots to cup 492. Hole 16 is located at tee area 468 and that hole is a par 5, 480 yard hole identified in play to hole 10. Hole 17 is located on core 420 and that hole is a par 4, 380 yard hole from tee area 474 and it is played identical to hole 4. Hole 18 is located on core 420 and is a par 3, 135 yard hole. Hole 18 is played from tee area 478 and the first shot is a 135 yard shot to green 486, and the second and third shots are putting shots to cup 494.

Figure 12:
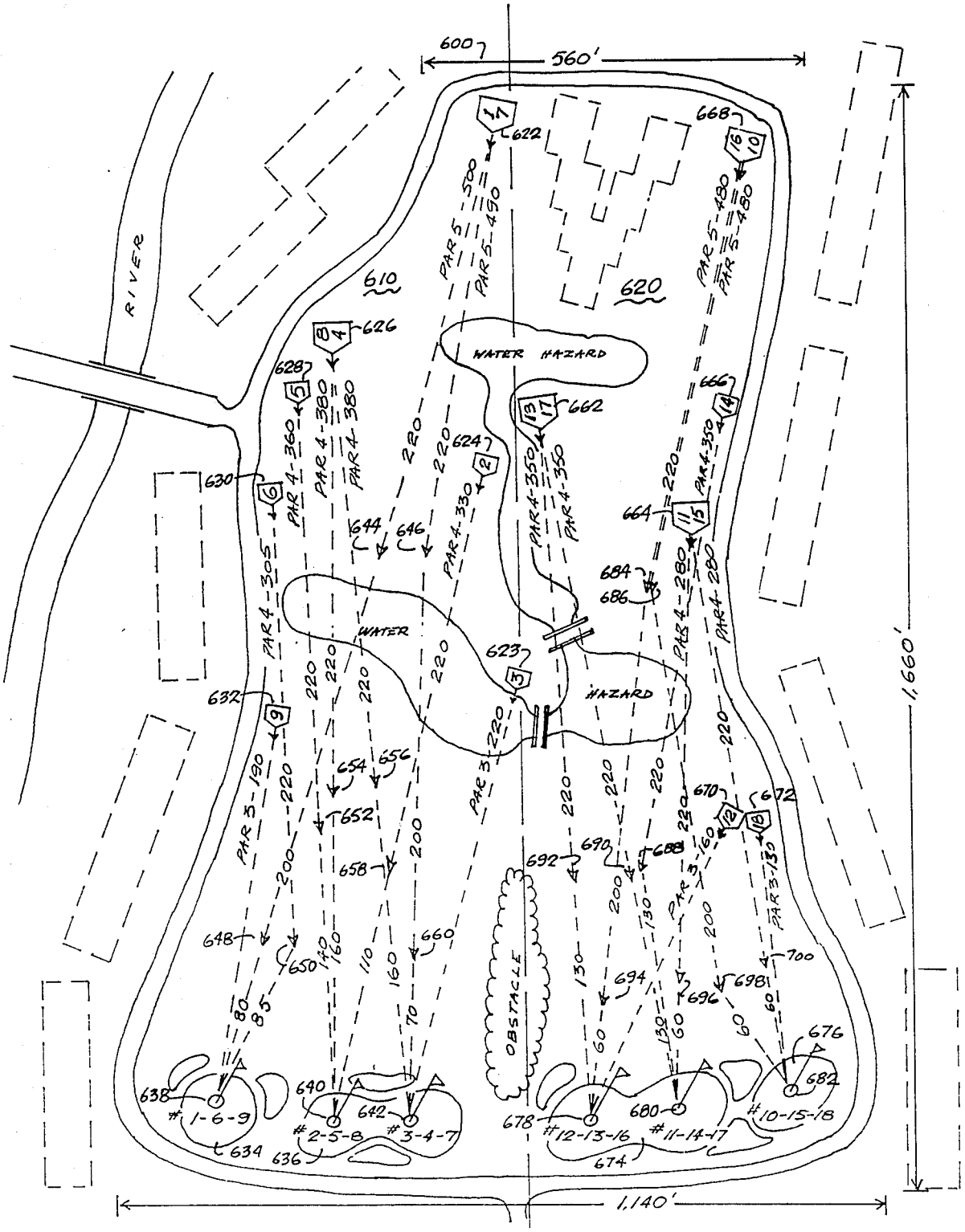
FIG. 12 is a plan view of a 35 acre, eighteen hole golf course.

FIG. 12 discloses an 18 hole golf course 600 which is 35 acres in area. The golf course is 1140 feet wide at its widest end and is approximately 1660 feet long. Nine holes are located on core 610 and nine holes are located on core 620. The legend disclosed in FIG. 13 lists a total of 18 holes having 6,015 yards of play. There are four par 3 holes, ten par 4 holes and four par 5 holes. Hole 1 is a par 5, 500 yard hole beginning at tee area 622. The first shot is a 220 yard shot to point 644 on core 610. The second shot is a 200 yard shot to point 648 and the third shot is an 80 yard shot to green 634. The fourth and fifth shots are putting shots to cup 638. Hole 2 is a par 4, 330 yard hole wherein the first shot from tee are 624 is a 220 yard shot to point 658. The second shot is a 110 yard shot to green 636 and the third and fourth shots are putting shots to cup 640. Hole 3 is a par 3, 220 yard hole wherein the first shot is a 220 yard shot to green 636, and the second and third shots are putting shots to hole 642. Hole 4 is a par 4, 380 yard hole from tee area 626. The first shot is a 220 yard shot to point 656 and the second shot is a 160 yard shot to green 636. The third and fourth shots are putting shots to cups 642. Hole 5 is a par 4, 360 yard hole from tee area 628. The first shot is a 220 yard shot to point 652 and the second shot is a 140 yard shot to green 636. Third and fourth shots are putting shots to cup 640. Hole 6 is a par 4, 305 yard hole from tee area 630. The first shot is a 220 yard shot to point 650 and the second snot is an 85 yard shot to green 634. The third or fourth shots are putting shots to cup 638. Hole 7 is a par 5, 490 yard hole from tee area 622. The first shot is a 220 yard shot to point 646. The second shot is a 200 yard shot to point 660 and the third shot is a 70 yard shot to green 636. The fourth and fifth shots are putting shots to cup 642. Hole 8 is a par 4, 380 yard hole from tee area 626. The first shot is a 220 yard shot to point 654 and the second shot is a 160 yard shot to green 636. The third and fourth shots are putting shots to cup 640. Hole 9 is a par 3, 190 yard hole from tee area 632. The first shot is a 190 yard shot to green 634 and the second and third shots are putting shots to cup 638. Holes 10 through 18 are located on core 620. Hole 10 is a par 5, 480 yard hole from tee area 668. The first shot is a 220 yard shot to point 686 and the second shot is a 200 yard shot to point 698. The third shot is a 60 yard shot to green 676 and the fourth and fifth shots are putting shots to cup 682. Hole 11 is a par 4, 280 yard hole from tee area 664. The first shot is a 220 yard shot to point 696 and the second shot is a 60 yard shot to green 674. The third and fourth shots are putting shots to cup 680. Hole 12 is a par 3, 160 yard hole from tee area 670. The first shot is a 160 yard shot to green 674 and the second and third shots are putting shots to cup 678. Hole 13 is a par 4, 350 yard hole from tee area 662. The first shot is a 220 yard shot to point 692 and the second shot is a 130 yard shot to green 674. The third and fourth shots are putting shots to cup 678. Hole 14 is a par 4, 350 yard hole from tee area 666. The first shot is a 220 yard shot to point 688 and the second shot is a 130 yard shot to green 674. The third and fourth shots are putting shots to cup 680. Hole 15 is a par 4, 280 yard hole from tee area 664. The first shot is a 220 yard shot to point 700 and the second shot is a 60 yard shot to green 676. The third and fourth shots are putting shots to cup 682. Hole 16 is a par 5, 480 yard hole from tee area 668. The first shot is a 220 yard shot to point 684 and the second shot is a 200 yard shot to point 694. The third shot is a 60 yard shot to green 674. The fourth and fifth shots are putting shots to cup 678. Hole 17 is a par 4, 350 yard hole from tee area 662. The first shot is a 220 yard shot to point 690 and the second shot is a 130 yard shot to green 674. The third and fourth shots are putting shots to cup 680. Hole 18 is a par 3, 130 yard hole from tee area 672. The first shot is a 130 yard shot to green 676 and the second and third shots are putting shots to cup 682.

Figure 14:
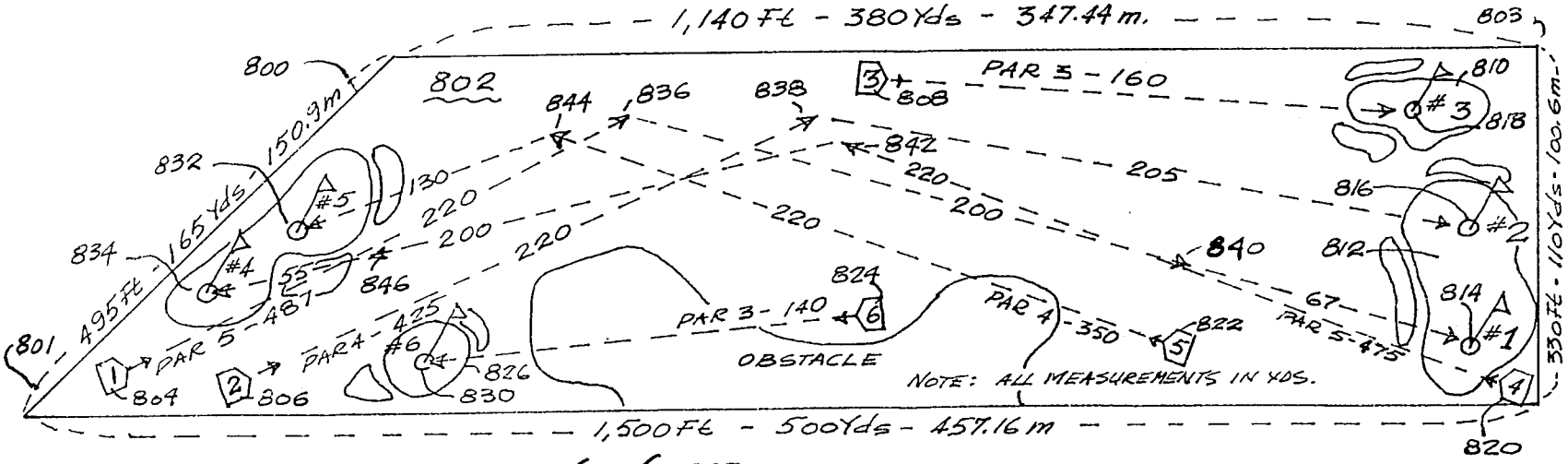
FIG. 14 is a plan view of a 10 acre, six hole golf course.

Referring to FIG. 14 there is shown a one core golf course 800 having six holes. Core 802 has a pair of opposite ends 801 and 803. A plurality of greens 828, 826, 810 and 812 are located on the core. Each green comprises at least one hole or cup. A plurality of tee areas 804, 806, 808, 820, 822 and 824 are located on the core. The holes are arranged relatively close to one another and at least one hole is located relatively close to one opposite end 801. At least one hole is also located relatively close to the other opposite end 803. At least one tee area is located relatively close to one opposite end 801 and at least another tee area is located relatively close to the other opposite end 803. On course 800, there is a tee area which is located on the core for each hole which is located on the core. There is an average of two group of three holes per core and a tee area for each hole. There are two groups of greens, each group having three holes. At least two holes in one group of three holes are located relatively close to one opposite end. At least two holes in the other group of three holes are located relatively close to the other opposite end. The tee areas are arranged in groups of three, each group of tee areas corresponding to one of the group of holes. At least two tee areas in one group of tee areas are located relatively close to one opposite end and at least two tee areas in the other group of tee areas are located relatively close to the other opposite end. Hole one is par 5, 487 hole wherein the first shot is a 220 yard shot to point 836. The second shot is a 200 yard shot point 840 and the third shot being a 67 yard shot to green 812. The fourth and fifth shots are putting shots to cup 814. Hole two is a par 4, 425 yard hole with the first shot from tee area 806 shot to point 838, 220 yards away. The second shot is a 205 yard shot to green 812 and the third and fourth shots are putting shots to cup 816. Hole three is a par 3, 160 yard hole from tee area 808. The first shot is a 160 yard shot to green 810 and the second and third shots are putting shots to cup 818. Hole four located near end 803 is a par 5, 475 yard hole from tee area 820. The first shot is a 220 yard shot to point 842 and the second shot is a 200 yard shot to point 846. The third shot is a 55 yard shot to green 828 the fourth and fifth shots are putting shots to cup 834. Hole 5 is a par 4, 350 yard hold from tee area 822. The first shot is a 220 yard shot to point 844 and the second shot is a 130 yard shot to green 828. The third and fourth shots are putting shots to cup 832. Hole 6 is a par 3, 140 yard hole from tee area 824. The first shot is a 140 yard shot to green 830 and the second and third shots are putting shots to cup 826. The shape of golf course 800 is approximately rectangular and it is approximately 1500 feet/500 yards long and 330 feet/110 yards wide. There are a total of 2037 yards of play on this course with two par 3 holes, two par 4 holes and two par 5 holes.

For all of the golf courses described herein, there is may be provided marking means such as a flag or the like on each tee area which is visually distinguishable from the marking means of every other tee area on the course. In addition, each green may comprise marking means such as a flag or the like which is visually distinguishable from the marking means on every other green on the core, but which is substantially similar to the marking means of its corresponding tee area. Thus, the marking means on tee area 804 will be identical to the marking means in cup 814. Target means also may be provided on the fairway which comprises marking means such as a flag or the like which is substantially similar to the marking means or the holes area and the marking means on the green for helping the player aim the golf ball for the best position on the fairway. In addition to the foregoing, a plurality of golf balls are provided for each group of players that play the course wherein each ball being is distinguishable from the other balls. By way of example, but not by way of limitation, by referring to FIG. 1, tee area 12 may be identified by a red flag and cup 26 on green 20 may also identified by a red flag. Likewise, a red flag also identifies points 28 and 32 on the fairway. Thus, when each player plays hole 1 from tee area 12, he/she would be aiming for the red marker at point 28. For the second shot, each player would be aiming for the red marker at point 32; and for the third shot, each player would be aiming for the red flag at cup 26. The markers used on holes 2 and 3 would be some other color, such as blue or orange. The marking system would enable players to hit their balls to the targeted areas, in order to maximize the yardage of each shot which would help the players play the game faster.

B. METHOD OF PLAY

Having thus described the overall design of the embodiments of the golf course attention is now directed to the method of playing the course. Referring to FIG. 1, the method of play will be described which can be easily adapted to a plurality of cores, each core being played in the manner described for FIG. 1. A plurality of players, such as four players, preferably plays together in a unit, each having a with golf ball which is visually distinguishable from the golf ball of every other player in that unit. The first group of players begins play at hole number one and each player hits his or her first shot from tee area 12. Tee area 12 has a colored flag corresponding to hole one's other marker flags along the fairway. All the players initiate a first shot before any one player initiates a shot to the green of any one hole. For his/her first shot, each player consecutively shoots and aims at point 28 along the fairway which preferably has a colored flag at point 28 which is the same color as the flat at tee area 12. The players then move on to hole two at tee area 14 which has a flag of a different color than the flat at hole one. The players aim their first ball at point 30 along the fairway, which has a marking flag of the same color as the flag at tee area 14. After all players have hit their first shot at hole two they then proceed to their first ball which was shot from hole one and which is preferably in the area of point 8. They shoot their second shots from hole one, the players then shoot their second shot for hole two.

The ball for hole two should ideally be in close proximity to point 30 along the fairway. The players hit their second shot for hole two aiming toward the cup for hole 2 on green 20. After the players hit their second shot for hole two, they then go to hole three at tee area 16 and hit their first shot for hole three aiming towards green 18. The players then proceed to hit their third shot from hole one which should be near point 32. They then put out on holes one, two and three. Obviously, the sequence of play may be modified in the event the balls do not lie at the ideal points along the fairway. For example, if the first shots from hole one or two lies to the right of hole three, the players may play hole 3 before they shoot their second shot for hole one or two. The object being that all balls farthest from the cups are shot first before any new tee shots are made. Thus, if one player shoots a ball to the left of point 28 and the other players shoot their balls at points to the right of point 30 or tee area 16, then the player whose balls lies to the left of point 28 will shoot first; all the players will then shoot their first shot from tee area 16 (hole 3) and then the remaining players will shoot their second shots from points to play to the right of tee area 16. The object of this method of play is to provide an efficient, fast, free-flowing movement of play, providing a course which allows the simultaneous play of three holes of golf without sacrificing regulation yardage.

A second group of players can begin to play the course disclosed in FIG. 1 after the first group of players hits their second shots on holes one and two. Again, after the second unit of players hits their second shots on holes one and two, a third group of players can begin play at holes one and two. Thus, it can be seen that a total of 12 players can play the course disclosed in FIG. 1 at any given time after the first group of players begin to putt out. If the first group of players desires to play six holes all they have to do is to go back to holes one and two and begin playing again. Obviously, they can play any number of times in multiples of three holes.

Referring to FIG. 3, the method of play is identical to the method of play f the course in FIG. 1 except that there are now six holes to play before having to repeat a hole. Referring to FIG. 3 the first group of players starts at hole one at tee area 44 and each player hits his/her first shot aiming at point 60 along the fairway. They then go to hole two and play that hole to point 62 along the fairway. They then walk to the first ball hit from hole one and aim that ball at cup 58. The players then walks to point 62 and shoot their second shot to cup 56. They then walk to hole 3 and shoot their first shot to cup 54 on green 50. They then walk to their third shot for hole one ideally hitting the green and then proceed to put out on holes one, two and three. The group then begin to play holes four, five and six in the same manner as they played holes one, two and three. In this embodiment of the invention, a total of 24 players can play the course at any given time. As soon as the first group of four players finish their second shots off holes one and two, a second group of players can begin playing holes one and two and so forth and so on until six groups of 4 players can simultaneously play the course until the first group of 4 players finishes putting out on holes four, five and six.

There are other methods of playing the golf course disclosed in FIG. 3. For example, at the same time that a first group of players begins play at hole one, a second group of players can begin play at on hole four.

The course disclosed in FIG. 5 is played in the same manner as the courses disclosed in FIGS. 1 and 3. The only difference being in FIG. 5 is that if there is an additional core 106. Therefore, the players can play nine holes of golf before repeating any three holes in a group of three. The golf course disclosed in FIG. 5 can accommodate 36 players at any given time.

The golf course disclosed in FIG. 8 shows six cores having 18 separate holes. Again, the method of play is identical to the method of play disclosed in the previous holes except that the players play 18 holes in groups of three. A total of 72 players can play simultaneously on the golf course as disclosed in FIG. 8.

The golf course disclosed in FIGS. 9 and 10 while structurally different than the previously disclosed golf courses comprises the same method of play. A first group of players begin at hole one (tee area 422). Each player hits his/her first shot to point 434 on core 410. The players then proceed to hole two and hit their first shot to point 436 along core 410. The players then hit their second shots for holes one and two and then hit their first shot from hole three at tee area 430 to green 448. After the players putt out on holes one, two and three in the same manner as previously disclosed for the course in FIG. 1. They then go back to the teeing areas and begin play at holes four, five and six on core 420. After playing holes four, five and six in a like manner, the players go back to the teeing areas to play holes, seven, eight and nine. After playing those holes the players then play holes ten through eighteen. The advantage of the golf course disclosed in FIG. 9 is that an eighteen hole, 6,400 yard game of golf can be played on only 20 acres of land.

The golf course disclosed in FIG. 13 is also an eighteen hole course except that this course is on 35 acres of land. The method of play is identical to the method of play in the previously disclosed courses, i.e., a group of three holes are played before a new group of three holes are played. Thus, the first shot from hole one (tee area 622) is shot to point 644 and the players then hit their second tee shoot from hole two (tee area 624). They then hit their second shot for hole one to point 648. The players then hit their tee shot from hole three (tee area 623) and then hit their second shot for hole two at point 658. They then hit their third shot for hole one at point 648 and then putt out on holes one, two and three. The players then play holes four, five and six and seven, eight and nine in the same manner. If the players desire to play the "back" nine holes, they then proceed to holes eleven through eighteen and play three consecutive holes in a group of three until all holes are played.

The golf course disclosed in FIG. 14 is a ten acre, six holes on that course. The players play holes one, two and three in the same manner as described in FIG. 1 and then play holes four, five and six in the same manner as they played holes one, two and three. The advantage to this method of design and play is that there are six holes can be played on only ten acres of land. As in all of the embodiments of the invention, the length of the holes are not in any way sacrificed because of the size of the course.

It should be noted that the time that the players play a "round" of golf on a core can be decreased if the supervising pros cannot meet the alloted time of play allowed, by simply increasing the diameter of one or more putting cups from the standard $4\frac{1}{4}''$ size to $5\frac{1}{4}''$.

The foregoing description and drawing merely explains and illustrates the invention and the invention is not limited thereto, except insofar as the independent claims are so limited as those who are skilled in the art and have the disclosure before them will be able to make modifications and variations therein without departing from the scope of the invention.

What is claimed is:

1. A substantially rectangular golf course for playing three holes simultaneously and comprising:

a pair of opposite ends and a pair of sides extending between said opposite ends;

a first plurality of greens comprising three holes;

each of said greens in said first plurality comprising at least one hole;

a first plurality of tee areas each comprising means for playing a respective one of said holes in the first plurality of greens;

said three holes in said first plurality of greens being arranged relatively close to one another so that the longest distance between adjacent holes is relatively small compared to the shortest distance between any of said three holes and its corresponding tee area;

a second plurality of greens comprising three holes;

each green in said second plurality of greens comprising at least one hole;

a second plurality of tee areas each comprising means for playing a respective one of said holes in the second plurality of greens;

said three holes in the second plurality of greens being arranged relatively close to one another so that the longest distance between adjacent holes is relatively small compared to the shortest distance between any of said three holes and its corresponding tee area;

at least one of said holes in each plurality of greens being located relatively close to one of said opposite ends;

all of said holes in each plurality of greens being located relatively remote from the other opposite end;

at least one tee area in each plurality of tee areas being located relatively close to the other opposite end;

all of said tee areas in each plurality of tee areas being located between said ends and relatively remote from said one end;

each green in said first plurality of greens being outside the area between any other green in said first plurality of greens and any of said first plurality of tee areas;

all of the tee areas in said first and second plurality of tee areas being outside of the area between any two greens in said first plurality of greens;

each green in said second plurality of greens being outside the area between any other green in said second plurality of greens and any of said second plurality of tee areas;

all of the tee areas in said first and second plurality of tee areas being outside of the area between any two greens in said second plurality of greens;

a first plurality of fairways located between said first plurality of tee areas and said first plurality of greens;

and a second plurality of fairways located between said second plurality of tee areas and said second plurality of greens;

said first and second pluralities of greens, tees and fairways being located on a pair of substantially rectangular cores disposed in adjacent, substantially side-by-side, nondiverging relation;

all of the relatively closely arranged plurality of holes in said golf course being located, as a group, other than along a side of said golf course;

all of the tee areas, for playing any plurality of relatively closely arranged holes, being located, as a group, other than both (1) along a side of the golf course and (2) at a location across from holes on the opposite side.

2. A golf course as recited in claim 1 wherein:

the greens for at least two holes in each plurality of greens lie on the same core;

at least two holes in each plurality of greens are located relatively close to said one opposite end;

and at least two tee areas in each plurality of tee areas are located relatively close to said other opposite end.

3. A golf course as recited in claim 2 wherein said first plurality of tee areas comprises:

at least one tee area located relatively remote from said one opposite end;

a first tee area situated to play one of said holes in said first plurality of holes in par 5;

a second tee area situated to play another of said holes in said first plurality of holes in par 4;

and a third tee area situated to play still another of said holes in said first plurality of holes in par 3.

4. A golf course as recited in claim 3 wherein said second plurality of tee areas comprise:

three tee areas each situated to play a respective one of said holes in said second plurality of holes in par 4.

5. A golf course as recited in claim 1 wherein each core has an area of about ten acres.

6. A golf course as recited in claim 5 wherein:

the long dimension of each substantially rectangular core is between 3 to 5 times the short dimension of the rectangular core.

7. A golf course as recited in claim 6, wherein said long dimension is about 4 times said short dimension.

8. A golf course as recited in claim 1 wherein:

each hole has a corresponding tee area, a fairway and green;

each tee area comprises marking means for marking said tee area and which is visually distinguishable from the marking means of every other tee area in the same plurality of tee areas;

each green comprises marking means for marking said green and which is visually distinguishable from the marking means of every other green in the same plurality of greens and which is substantially similar to the marking means of the corresponding tee area;

and each fairway comprises marking means for marking said fairway and which is substantially similar to the marking means for the corresponding tee area and green, to provide a target area for a player's first shot off the tee area for the corresponding hole.

9. A method of playing a golf course having a first plurality of at least three relatively close holes spaced from a first plurality of tee areas each for playing a respective hole in said first plurality of holes, a second plurality of at least three relatively close holes spaced from said first plurality of holes and also spaced from a second plurality of tee areas each for playing a respective hole in said second plurality of holes, said three holes in each plurality of holes being arranged relatively close to one another so that the longest distance between adjacent holes is relatively small compared to the shortest distance between any of said three holes and its corresponding tee area, said method comprising the steps of:

teeing-off from said first plurality of tee areas for all the holes in said first plurality of holes before putting-out on any hole in said first plurality of holes;

putting-out on all of said holes in the first plurality of holes before teeing-off for any of the holes in said second plurality of holes;

all of said holes in the first plurality of holes being played simultaneously as a group;

teeing-off from said second plurality of tee areas for all the holes in said second plurality of holes after putting-out on all the holes in said first plurality of holes and before putting-out on any hole in said second plurality of holes;

putting-out on all of said holes in the second plurality of holes before any further teeing-off;

all of the said holes in the second plurality of holes being played simultaneously as a group;

and playing said first and second plurality of holes sequentially, each plurality as a group.

* * * * *